US008408217B2

(12) United States Patent
Kalish et al.

(10) Patent No.: US 8,408,217 B2
(45) **Date of Patent: *Apr. 2, 2013**

(54) NAIL CLEANING APPARATUS

(76) Inventors: Jonathan Reed Kalish, Tupelo, MS (US); Cathy Gunn Kalish, Tupelo, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/614,233

(22) Filed: Nov. 6, 2009

(65) Prior Publication Data

US 2010/0051042 A1 Mar. 4, 2010

Related U.S. Application Data

(63) Continuation of application No. 11/670,306, filed on Feb. 1, 2007.

(60) Provisional application No. 60/764,159, filed on Feb. 1, 2006.

(51) Int. Cl.
*A45D 29/00* (2006.01)
*A45D 29/18* (2006.01)

(52) U.S. Cl. ..... 132/73.5; 132/73

(58) Field of Classification Search ..... 132/73, 132/73.5, 75.6, 76.4; 15/104.93, 104.94, 15/105, 118; 401/6

See application file for complete search history.

(56) References Cited

U.S. PATENT DOCUMENTS

| | | | | |
|---|---|---|---|---|
| 3,467,978 | A * | 9/1969 | Golden | 15/111 |
| 4,420,853 | A * | 12/1983 | Gilman et al. | 15/111 |
| 4,480,351 | A | 11/1984 | Koffler | |
| 4,730,949 | A | 3/1988 | Wilson | |
| 4,866,806 | A | 9/1989 | Bedford | |
| 4,886,078 | A | 12/1989 | Shiffman | |
| 4,939,529 | A | 7/1990 | Kanayama et al. | |
| 5,312,197 | A | 5/1994 | Abramson | |
| 5,355,545 | A | 10/1994 | Hoagland | |
| 6,016,812 | A | 1/2000 | Guynn | |
| 6,102,048 | A | 8/2000 | Baker | |
| 6,289,547 | B1 | 9/2001 | Narula et al. | |
| 6,370,724 | B1 * | 4/2002 | Holmes et al. | 15/111 |
| 6,813,798 | B2 | 11/2004 | Moga | |
| 6,821,043 | B2 | 11/2004 | Teh | |
| 2003/0081980 | A1 | 5/2003 | Moga | |

* cited by examiner

*Primary Examiner* — Robyn Doan
(74) *Attorney, Agent, or Firm* — Banner & Witcoff, Ltd.

(57) ABSTRACT

Aspects of the invention relate to apparatuses and methods for improving sanitary conditions. Certain aspects relate to an apparatus having at least one protrusion for removing visible debris from a nail and at least one nail cleaning region comprising an impregnable material for containing a liquid. In one exemplary embodiment, several nail cleaning elements may be configured to each clean a different nail without cross contaminating any other nail cleaning element on the apparatus. In various exemplary embodiments, the liquid comprises an agent selected from the group consisting of: a biocide agent, moisturizing agent, a cleaning agent, and combinations thereof. Multiple nail cleaning elements may be positioned to permit the simultaneous cleaning of multiple nails without cross-contamination.

17 Claims, 3 Drawing Sheets

NAIL CLEANING APPARATUS

CROSS REFERENCE TO RELATED APPLICATIONS

This application is a continuation application of U.S. patent application Ser. No. 11/670,306, filed Feb. 1, 2007, which claims the benefit of U.S. Provisional Application No. 60/764,159, filed on Feb. 1, 2006, the disclosures of which are hereby incorporated by reference in their entirety.

FIELD OF THE INVENTION

The invention relates to apparatuses and methods for improving sanitary conditions. In particular, this invention relates to apparatuses for cleaning nails and surrounding areas.

BACKGROUND

In a recent survey of medical professionals, sanitation was rated most important medical advance since 1840. Indeed, preventing cross-contamination from infected individuals, food, and/or drinking water has saved millions of lives. Nonetheless, further improvements in sanitary conditions could save several more lives and drastically reduce the spread of disease. Research has further shown that many preventable diseases rapidly spread through individual's hands, thus prompting tools and methods for reducing germs spread through this medium.

There are several professions where it is desirable to reduce diseases and germs that are transmitted through human handling of items. For example, medical personnel must often rapidly switch from treating patients to touching keyboards or paper files to review and update the patient's medical records. Further, workers in the food industry, such as employees handling raw and/or cooked food items may potentially contaminate the food and/or further spread contaminated food. In still yet another example, employees who handle cash, especially fibrous paper money, are potentially spreading germs and/or diseases.

Prior attempts to increase sanitary conditions of human hands have focused on antimicrobial creams and/or soaps. While somewhat effective, it is often cumbersome if not impossible to clean every curve and/or crevice of the hand. This is especially true the area surrounding the fingernails. Given the shape of the nails, its innate ability to break skin or food coverings, and close proximity to the skin, the nail area is well-suited to harbor germs and debris.

Devices for cleaning nails having historically included picks and the like. Generally, these devices allow for the removal of visible debris. However, the pick is generally used on multiple nails, thus leading to cross contamination. Another option is using a different pick for each nail, which is often more cumbersome, expensive, and/or leads to further cross contamination. Further, the picks are often thin sharp utensils, further increasing the chances of breaking the skin or endangering a third-party, such as children.

Other devices for cleaning nails have included sponges, however, conventional sponges allow cross-contamination to other nails and surrounding areas. Conventional sponges often lack the structural integrity to remove visible debris. Solutions to these and other shortcomings may be realized with features and advantages of the invention or of certain embodiments of the invention, which will be apparent to those skilled in the art from the following disclosure and description of exemplary embodiments.

BRIEF SUMMARY

In accordance with one aspect, an apparatus is provided that has at least one protrusion for removing visible debris from a nail and at least one nail cleaning region comprising an impregnable material for containing a liquid is provided. In one exemplary embodiment, several nail cleaning elements may be configured to each clean a different nail without cross contaminating any other nail cleaning element on the apparatus. In various exemplary embodiments, the liquid comprises an agent selected from the group consisting of: a biocide agent, moisturizing agent, a cleaning agent, and combinations thereof. In yet further embodiments, one or more dry cleaning regions may be utilized in addition to or instead of one or more wet cleaning regions.

In accordance with another aspect, multiple nail cleaning elements are positioned to permit the simultaneous cleaning of multiple nails without cross-contamination. In certain exemplary embodiments, multiple cleaning elements may be positioned in a relatively parallel arrangement. In other embodiments, the apparatus includes nail cleaning regions at two opposing ends. In one exemplary embodiment, the apparatus is foldable.

It will be appreciated by those skilled in the art, given the benefit of the following description of certain exemplary embodiments of an apparatus or methods of using the same that at least certain embodiments of the invention have improved or alternative configurations suitable to provide desirable properties depending on, for example, different quality, costs, and/or intended uses. These and other aspects, features and advantages of the invention or of certain embodiments of the invention will be further understood by those skilled in the art from the following description of exemplary embodiments.

BRIEF DESCRIPTION OF THE DRAWINGS

The present invention may take physical form in certain parts and steps, a few embodiments of which will be described in detail in the following description and illustrated in the accompanying drawings that form a part hereof, wherein.

DETAILED DESCRIPTION

It should be understood that different exemplary embodiments in accordance with this disclosure may have any of numerous different specific configurations or constitutions. The composition and configuration of an apparatus in accordance with this disclosure can vary to a certain extent, depending upon such factors as the product's intended market segment, its desired use or uses, desired characteristics and/or costs. For example, in some uses it will be desirable to create an entirely disposable apparatus, yet in other embodiments, portions of the apparatus may be cleaned, autoclaved, sterilized, or the like and reused. For example, one or more disposable cartridges may be positioned on a reusable body.

Figure 1:
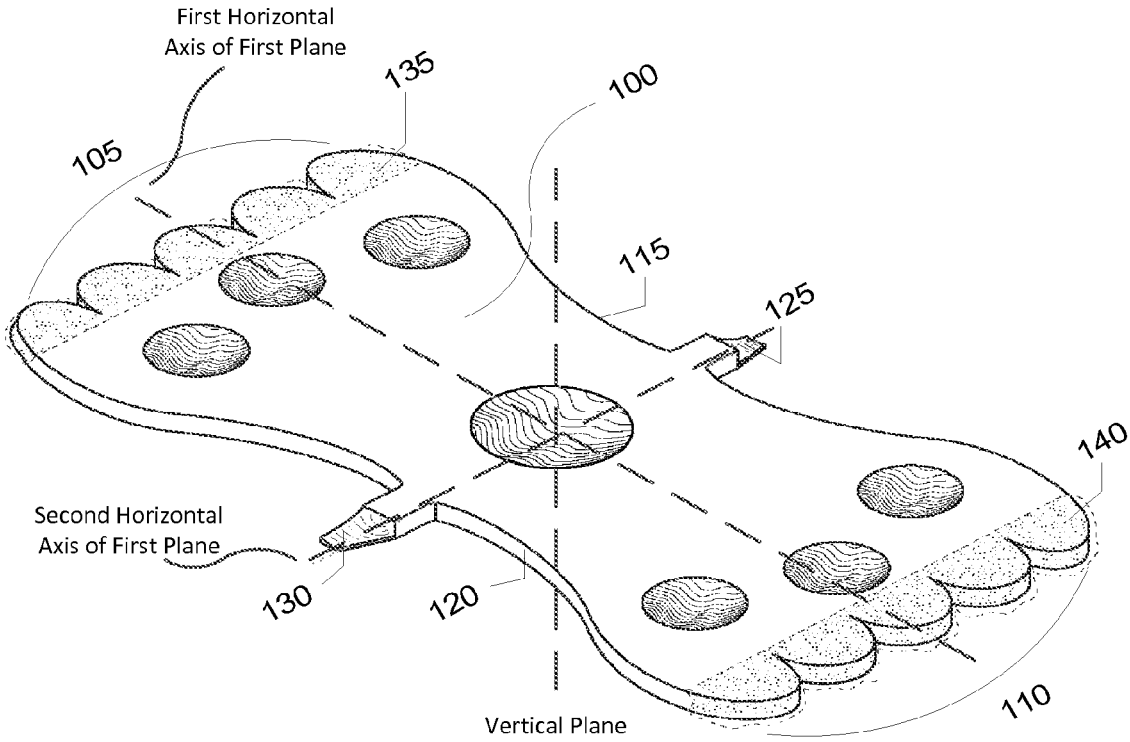
FIG. 1 is a perspective view of an exemplary nail cleaning apparatus according to one embodiment of the invention.

FIG. 1 is a nail cleaning apparatus according to one exemplary embodiment of the invention. Apparatus 100 comprises a unitary body having a first end 105 and a second end 110. The unitary body may be formed from one or more substantially rigid materials, such as for example, metal, wood, plastic, or rubber. As used herein "substantially rigid" refers to any material having sufficient structural integrity as to be held and have a force applied to it in an amount to clean the nail area without failure. Substantially rigid materials may be flexible, bendable, and shapable but are rigid enough to clean the nail area. Further, as used throughout this disclosure, the term "nail" refers to both fingernail and toenails and the area substantially adjacent to fingernails and toenails. Thus, reference to cleaning a nail is to be interpreted as cleaning a toenail and/or fingernail and/or the area in proximity to the nail. Indeed, it is common in the art and thus intended through this disclosure that references to cleaning nails may encompass cleaning under, over and/or around the curvature of the nail.

Returning to FIG. 1, exemplary apparatus 100 further comprises a first side 115 and a second side 120 in a substantial parallel arrangement. As seen in the illustrative example, each side (115 and 120) extends from the first end 105 to the second end 110. The exemplary sides (115 and 120) are presented as mirror images of each other, however, those skilled in the art will appreciate that in yet other embodiments, the sides may be of any shape or design, and not be arranged in a parallel fashion. Further, in certain embodiments, the body of apparatus 100 may be substantially circular, for example, thus there may be no clear indication of specific "sides", but rather just an overall shape. In still yet further embodiments, apparatus 100 is not substantially planar shaped as presented in FIG. 1, but may be convex, concave, or combinations of both among other general shapes. Indeed, apparatus 100 may be any shape as long as cross contamination is minimized or prevented under normal usage, as will be described in more detail below.

As seen in FIG. 1, one or more of the sides (115 and 120) may have at least one protrusion extending therefrom. For example, protrusion 125 extends from side 115 and protrusion 130 extends from side 120. The protrusion(s), such as protrusions 125 and 130 may be made of the same material as the side (or section of the apparatus) from which they extend from or be formed of or comprise different material. In certain embodiments, one or more protrusions comprise materials that are different than the materials of at least one other protrusion. For example, protrusion 125 may comprise a rigid plastic material, while protrusion 130 may comprise a rubber material that is more flexible and/or soft than the plastic material. Indeed, any material may be chosen that may remove visible debris from the nail area. As one skilled in the art will readily appreciate in view of this disclosure, the exact material(s) utilized for the protrusion(s) may depend on the intended usage, costs, and/or other factors.

Figure 2:
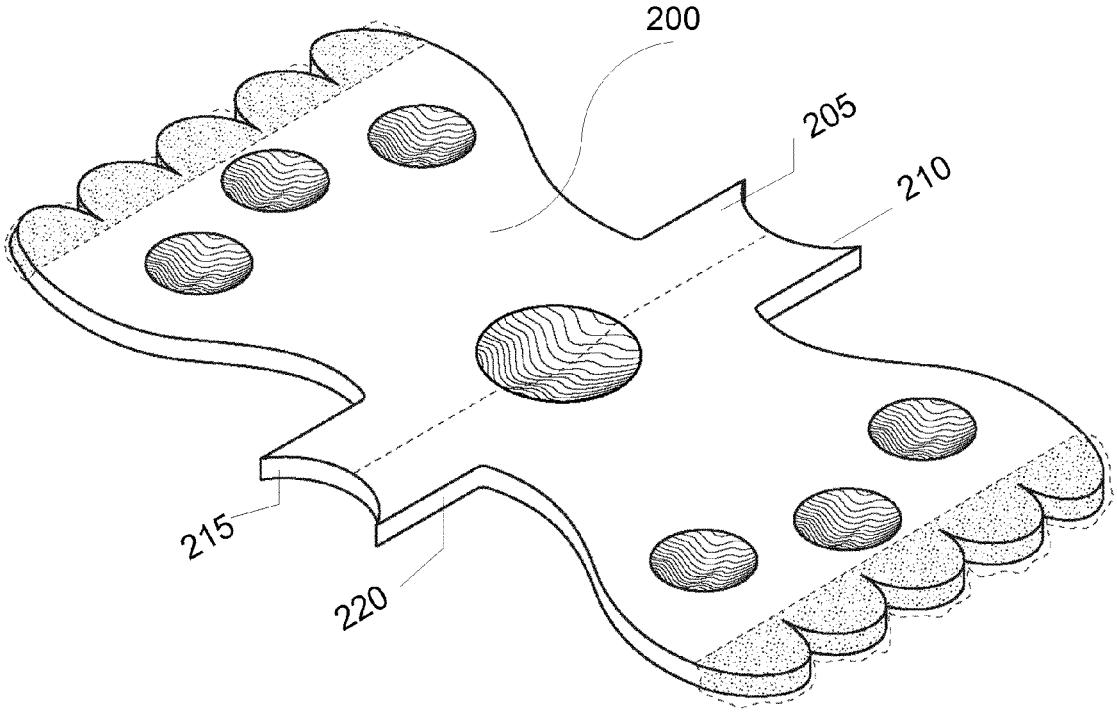
FIG. 2 is a perspective view of another exemplary nail cleaning apparatus according to at least one embodiment of the invention.

Further, while only one protrusion is shown on each side of the apparatus 100, more than one protrusion may be provided on one or more sides. For example, FIG. 2, shows apparatus 200, which substantially resembles apparatus 100, however, apparatus 200 comprises protrusions 205, 210, 215 and 220. Protrusions 205 and 210, for example, are positioned as such to create an indentation in between in a concave shape similar to a nail, and thus may be used as one protrusion to clean nails. The exact number and placement of the protrusions may depend on a myriad of factors. Indeed, protrusions may extend from any surface of the apparatus so long as usage of the protrusions to remove debris from the nail minimizes or prevents cross contaminate the nail cleaning elements (discussed below). Further, the shape and size of the protrusions will vary depending on the embodiment of the invention. For example, protrusions 125 and 130 are substantially wedge shaped, while protrusions 205 and 210 are not.

In addition to being substantially wedge shaped, exemplary protrusions 125 and 130 comprise one or more slopes along one or more axis and/or irregular shaped ridges configured to allow optimal removal of debris. In one embodiment, the slopes of exemplary protrusions 125 and 130 are located on opposing sides of the respective protrusion, such to permit the slope of protrusion 125 to be facing up while the slope of protrusion 130 is shaped to be facing down. Thus in one use, a user may utilize protrusion 125 to clean one or more fingernails on one hand, then flip over or reverse apparatus 100 and utilize protrusion 130 to clean one or more fingernails on another hand. Those skilled in the art will readily understand the exact shape and size of the protrusions will be selected based upon a myriad of factors which does not need to be discussed in more detail in this disclosure.

Returning to FIG. 1, first end 105 of apparatus 100 comprises a nail cleaning region, such as plurality of nail cleaning elements 135. The plurality of cleaning element 135 may comprise or be composed of an impregnable material for containing a liquid. As used herein, the term "liquid" encompasses mists, moisture, and/or copious amounts of fluid. The impregnable material may be any suitable material that may absorb liquid and retain at least a portion of it. As seen in the illustrative example, end 110 also comprises a plurality of nail cleaning elements 140. While in the illustrative embodiment, elements 140 closely resemble elements 135, other embodiments may utilize different sized and/or shaped elements. Further, other embodiments may utilize different impregnable materials for the elements, and/or impregnate the material with a different liquid or dose of liquid. For example, the plurality of elements 135 may be impregnated with an iodine solution, while the plurality of elements 140 may be impregnated with a solution to remove the iodine and/or further clean the nails.

The liquid chosen to impregnate one or more cleaning elements may be chosen for several reasons. In one embodiment, a biocide agent is utilized; however, the liquid may be any composition, including, for example, a moisturizing agent; a cleaning agent, and combinations thereof.

In yet further embodiments, one or more cleaning regions may be dry or otherwise substantially free or absent of liquid(s). In certain embodiments, the dry cleaning region(s) may be utilized in addition to or instead of one or more wet cleaning regions. For example, either plurality of elements 135 and/or plurality of elements 140 may be substantially free or absent of liquid(s). In certain embodiments, a cleaning region, such as plurality of elements 135 may comprise an impressionable material that may form around the nail when pressed against the nail. In such embodiments, one or more dry cleaning compositions may be embedded on or within said impressionable material, such that the nails are cleaned without the application of one or more liquids.

As presented on exemplary apparatus 100, the plurality of nail cleaning elements 135 are each in substantial parallel arrangement with each other. Other configurations are within the scope of the invention so long as the positioning permits the cleaning of a different nail by one nail cleaning element without cross contaminating any other nail cleaning element in the same nail cleaning region. Along these lines, different nail cleaning elements within the same nail cleaning region may be on different planes, such as being arranged in convex or concave and/or slanted arrangement. In certain embodiments, at least a portion of the plurality of nail cleaning elements are positioned to permit simultaneous cleaning of multiple nails while minimizing or preventing cross-contamination.

In certain embodiments, plurality of elements 135 and/or plurality of elements 140 may comprise disposable materials. In one embodiment, one or more disposable cartridges may be positioned on the apparatus. In one such embodiment, the apparatus 100 is made of stainless steel or material that may readily be sanitized or sterilized, such as through autoclaving, and removably attached to cartridges comprising cleaning elements.

Figure 3:
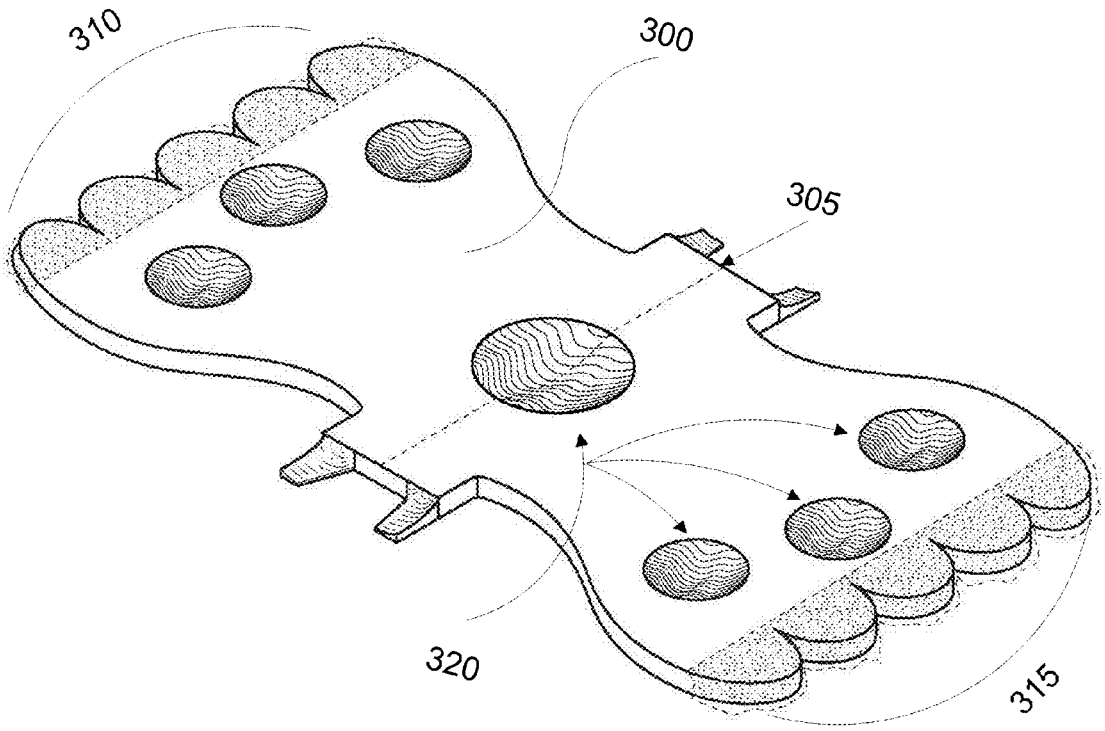
FIG. 3 is a perspective view of an exemplary nail cleaning apparatus having a flexible or folding portion according to one embodiment of the invention.

In still yet further embodiments, the nail cleaning apparatus may comprise one or more flexible or folding portions. FIG. 3 is a perspective view of an exemplary cleaning apparatus 300 having a flexible or folding portion according to one embodiment of the invention. As seen in the exemplary embodiment, cleaning apparatus 300 includes a flexible midline 305. In one instance, the flexible midline 305 permits a first end 310 to fold onto the second end 315.

Figure 4:
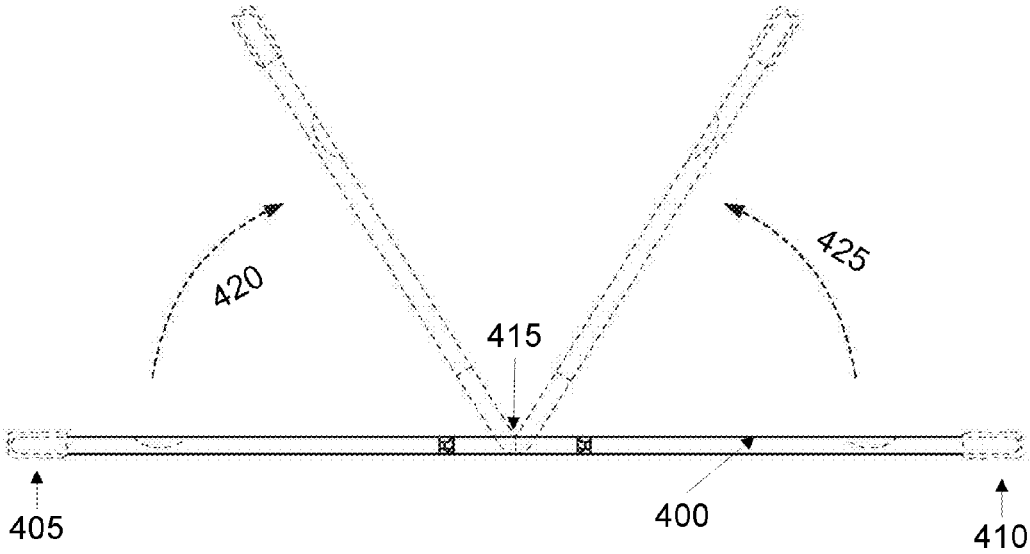
FIG. 4 shows a side view of an exemplary folding nail cleaning apparatus according to one embodiment of the invention.

FIG. 4 shows a side view of an exemplary folding nail cleaning apparatus according to one embodiment of the invention. As seen in FIG. 4, nail cleaning apparatus 400, being similar to apparatus 300, has at least a first end 405 and a second end 410. Further, apparatus 400 includes a flexible midline 415, which permits first end 405 to flex or fold in the direction of arrow 420 and second end to flex or fold in the direction of arrow 425. In one such embodiment, the cleaning apparatus may be shipped, distributed, or stored in a folded up state until ready for use. This may be advantageous for keeping the apparatus sanitary, retaining moisture of one or more liquid ingredients, and/or reducing storage and shipping costs. In one such embodiment, the apparatus may lock into a substantially fixed position once unfolded. This may be advantageous for increasing the structural integrity and/or in preventing reuse of the product. In one embodiment, the first end 405 and the second end 410 join to create a larger nail cleaning region. In yet other embodiments, the cleaning apparatus 400 may be folded after use to prevent cross contamination, lock the apparatus, reduce spilling of any liquid, and/or combinations thereof among others.

Returning to FIG. 3, apparatus 300 may include one or more grips. The grips may aid in the handling and use of the apparatus. In the illustrative embodiment, grips 320 are spaced in an ergonomic manner on a substantially planar surface of the apparatus 300. Those skilled in the art will readily appreciate upon reading this disclosure that other arrangements of grips and/or mechanisms to aid in the handling in use of the apparatus are within the scope and spirit of this disclosure.

Given the benefit of the above disclosure and description of exemplary embodiments, it will be apparent to those skilled in the art that numerous alternative and different embodiments are possible in keeping with the general principles of the invention disclosed here. Those skilled in this art will recognize that all such various modifications and alternative embodiments are within the true scope and spirit of the invention. The appended claims are intended to cover all such modifications and alternative embodiments. It should be understood that the use of a singular indefinite or definite article (e.g., "a," "an," "the," etc.) in this disclosure and in the following claims follows the traditional approach in patents of meaning "at least one" unless in a particular instance it is clear from context that the term is intended in that particular instance to mean specifically one and only one. Likewise, the term "comprising" is open ended, not excluding additional items, features, components, etc.

What is claimed is:

1. An apparatus comprising:

a unitary body having a first end and an opposing second end along a first axis of a horizontal plane, each end comprising a plurality of nail cleaning elements comprising an impregnable material configurable to receive a liquid, wherein at least a portion of the nail cleaning elements on each end being in substantial parallel arrangement with each other and each nail cleaning element further positioned to allow the cleaning underneath a different nail up to and including a location where the nail meets skin without cross contaminating any other nail cleaning element in the same nail cleaning region;

a first side and a second side of the body in substantial parallel arrangement each extending from the first end to the second end, wherein at least one of the sides comprises at least one substantially rigid protrusion that is formed integrally with the unitary body having width and a cross-sectional thickness configured to remove visible debris from the nail that terminates at a terminus where the width is greater than the cross-sectional thickness;

a flexible midline that is less rigid than the unitary body configured to permit the first end to fold onto the second end.

2. The apparatus of claim 1, wherein the first end is substantially identical to the second end.

3. The apparatus of claim 1, wherein the plurality of nail cleaning elements of the first end are positioned on a first removable cartridge and the plurality of nail cleaning elements of the second end are positioned on a second removable cartridge.

4. The apparatus of claim 1, wherein the impregnable material comprises a liquid and the liquid comprises an agent selected from the group consisting of: a biocide agent, moisturizing agent, a cleaning agent, and combinations thereof.

5. The apparatus of claim 1, wherein the at least one protrusion is substantially wedge shaped.

6. The apparatus of claim 1, wherein at least a portion of the plurality of nail cleaning elements are positioned to permit the simultaneous cleaning of multiple nails without cross-contamination.

7. An apparatus comprising:

a substantially rigid unitary body having at least one fixed protrusion configured to remove debris from a nail; and at least one nail cleaning region on the unitary body that is separate from the at least one protrusion configured to attach to a removable cartridge that contains the plurality of nail cleaning elements comprising:

an impressionable material that is less rigid than the unitary body, the nail cleaning region having at least a first section and a second section, wherein each section is configured to allow the cleaning underneath a different nail up to and including a location where the nail meets skin, wherein the cleaning underneath a different nail up to and including a location where the nail meets skin with the first section may be performed without cross-contaminating the second section, the at least one nail cleaning region further being positioned to prevent cross contamination from the at least one protrusion.

8. The apparatus of claim 7, wherein the at least one nail cleaning region comprises a dry agent selected from the group consisting of: a biocide agent, a cleaning agent, and combinations thereof.

9. The apparatus of claim 7, wherein the apparatus comprises a first nail cleaning region and a second nail cleaning region.

10. The apparatus of claim 9, wherein the first and second cleaning regions are each configured to each be attachable to a removable cartridge containing at least a portion of the plurality of nail cleaning elements.

11. The apparatus of claim 9, wherein the substantially rigid body comprises a flexible midline that is less rigid than the unitary body configured to permit the first end to fold onto the second end.

12. An apparatus comprising:

a substantially rigid unitary body comprising a first end extending along a first axis of a horizontal plane from a first terminus nail cleaning region to a middle section of the unitary body and further comprising a second end extending along the first axis from the middle section to a second terminus nail cleaning region;

wherein the unitary body is further defined by a first side and a second side, each extending from the nail cleaning region of the first end to the nail cleaning region of the second end to define a length of the unitary body and further define a thickness of the body along a vertical plane that is perpendicular to the horizontal plane, wherein the thickness is less than the length;

a pair of opposing substantially rigid protrusions formed integrally with the unitary body proximate to the middle section, wherein a first protrusion extends from the first side and a second protrusion extends from the second side in an opposing manner with respect to a second axis of the horizontal plane that is perpendicular to the first axis;

wherein the protrusions each have a width and a cross-sectional thickness configured to remove visible debris from a nail that terminates at a terminus where the width is greater than the cross-sectional thickness; and wherein the nail cleaning regions each comprise a plurality of nail cleaning elements comprising an impregnable material configurable to receive a liquid, wherein the nail cleaning elements on each end being in substantial parallel arrangement with each other on the same nail cleaning region with respect to the first axis of the horizontal plane, each nail cleaning element further positioned to allow the cleaning underneath a different nail up to and including a location where the nail meets skin without cross contaminating any other nail cleaning element in the same nail cleaning region.

13. The apparatus of claim 12, wherein the apparatus is foldable on a flexible midline located in the middle section of the apparatus and extends along the second axis of the horizontal plane.

14. The apparatus of claim 13, further comprising a second pair of opposing substantially rigid protrusions formed integrally with the unitary body proximate to the middle section, wherein a third protrusion extends from the first side and a third protrusion extends from the second side in an opposing manner with respect to a second axis of the horizontal plane that is perpendicular to the first axis;

wherein the first and the third protrusion extend from the first side and are equidistant from the midline.

15. The apparatus of claim 13, wherein the apparatus is configured such that folding of the unitary body on the flexible midline results in the first and the second nail cleaning regions to be in substantial proximity with respect to the vertical plane to create a single third nail cleaning region that consists of the first nail cleaning region and the second nail cleaning region.

16. The apparatus of claim 15, wherein the apparatus is configured such that folding of the unitary body on the flexible midline further results in the first and the third protrusions to be in substantial proximity with respect to the vertical plane.

17. The apparatus of claim 12, wherein the nail cleaning region is configured to be attached to a removable cartridge containing the plurality of nail cleaning elements.

* * * * *